US008282200B2

(12) United States Patent
Ootsuka

(10) Patent No.: US 8,282,200 B2
(45) Date of Patent: Oct. 9, 2012

(54) LIQUID SUPPLYING RESERVOIR

(75) Inventor: Hiroyuki Ootsuka, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 357 days.

(21) Appl. No.: 12/712,224

(22) Filed: Feb. 25, 2010

(65) Prior Publication Data

US 2010/0245500 A1 Sep. 30, 2010

(30) Foreign Application Priority Data

Mar. 24, 2009 (JP) ..... 2009-071936

(51) Int. Cl.
*B41J 2/175* (2006.01)

(52) U.S. Cl. ..... 347/86

(58) Field of Classification Search ..... 347/85, 347/86, 87

See application file for complete search history.

(56) References Cited

U.S. PATENT DOCUMENTS 5,721,576 A * 2/1998 Barinaga ..... 347/85
6,053,603 A * 4/2000 Ito ..... 347/85
7,209,689 B2 * 4/2007 Matsumoto et al. ..... 399/262
7,552,837 B2 * 6/2009 Nanjo et al. ..... 220/360

FOREIGN PATENT DOCUMENTS

JP 2003-267438 A 9/2003

* cited by examiner

*Primary Examiner* — Ahn T. N. Vo
(74) *Attorney, Agent, or Firm* — Solaris Intellectual Property Group, PLLC

(57) ABSTRACT

A liquid supplying reservoir enabling preventing overflow of liquid from a supply opening when a cap covering the supply opening is removed is provided. The ink supplying reservoir includes: a reservoir main body which is filled with a liquid, and at which a supply opening, from which the liquid is supplied to the outside, is formed; a cap which is fixed to the reservoir main body so as to cover the supply opening, and which is separated from the reservoir main body when a force of a predetermined value or greater acts thereon; and a flexible closing member, which is accommodated within the cap at a position or an orientation where the supply opening is not closed by the closing member and so as to be separable from the cap, and which is moved to close the supply opening when the cap is separated from the reservoir main body.

16 Claims, 12 Drawing Sheets

LIQUID SUPPLYING RESERVOIR

CROSS-REFERENCE TO RELATED APPLICATION

This application claims priority under 35 USC 119 from Japanese Patent Application No. 2009-071936 filed Mar. 24, 2009, the disclosure of which is incorporated by reference herein.

BACKGROUND OF THE INVENTION

1. Technical Field

The present invention relates to a liquid supplying reservoir.

2. Related Art

A replaceable ink cartridge (hereinafter also referred to simply as an "ink cartridge"), which is formed separately from a recording head included in an inkjet recording apparatus in which recording is performed by ejecting an ink to a recording medium (for example, a sheet) and which supplies an ink to the recording head via an ink supply channel, is known.

In many cases of an ink cartridge, an ink absorbing body is mounted in a housing body of the ink cartridge, and the ink absorbing body holds an ink such that the ink becomes dense in the vicinity of an ink supply opening from which the ink is supplied to a recording head and the ink becomes non-dense at the side of an atmospheric communication opening which causes the interior of the ink cartridge to communicate with the atmosphere when the ink cartridge is attached in the inkjet recording apparatus.

In this type of ink cartridge, a packaging mode in which the ink supply opening and the atmospheric communication opening are sealed by a sealing member is used in preparation for leakage of an ink at the time of physical distribution. For example, the sealing state of the ink cartridge is maintained by carrying out adhesion or thermal bonding of the sealing member for peripheral edge portions of the ink supply opening and the atmospheric communication opening.

The aforementioned packaging mode is inexpensive and allows reliable sealing of the ink cartridge, and therefore, it is applied to a large number of ink cartridges. Further, unsealing (opening) of the ink supply opening and the atmospheric communication opening is carried out by a user directly stripping off the sealing member.

However, in consideration of an increase in pressure of an interior of the ink cartridge, resulting from environmental variation at the time of the distribution, there are cases in which adhesion or thermal bonding of the sealing member may be carried out strongly. In these cases, the user needs to strip off the sealing member with larger power, and as a result, the sealing member may be burst-removed from the ink cartridge with great force. As a result, there is a possibility that the ink sealed in the ink cartridge by means of the sealing member may be scattered and may hang (fly) to the user's body or surrounding things.

As the technology that prevents scatter of ink from the ink cartridge as described above, for example, the technique described in Japanese Patent Application Laid-Open (JP-A) No. 2003-267438 (patent document 1) is known. According to the technique described in patent document 1, as shown in FIG. 11, an ink supply opening is covered by a cap and the cap is bonded to a housing body of the ink cartridge. In the ink cartridge having the above-described structure, when the ink supply opening is unsealed (opened), the bonded portion is sheared off by rotating the cap on the ink supply opening with the central portion of the ink supply opening being as an axis, and subsequently, the cap is removed. To this end, no cubical expansion of the interior of the ink cartridge occurs at the time of unsealing the cap. Further, since the cap is removed after the bonded portion is sheared off, there is no possibility that the ink supply opening is unsealed in burst. Moreover, by a structure in which no clearance between the ink supply opening and the cap is formed, a scheme of reducing an ink which freely exists inside the cap before unsealing as far as possible is carried out.

However, in the technique described in patent document 1, when the ink supply opening is unsealed, an operation of twisting the cap is necessary. Many users hold the side surfaces of the housing body of the ink cartridge with one hand and grasp and twist the cap with the other hand. In this case, at the moment that the bonded portion is sheared off, stronger force is applied to the side surface of the housing body. Therefore, the side surface of the housing body is pushed, so that ink may overflow from the ink supply opening. As a result, there exists a problem that the ink may hang to the user's body or surrounding things. Even if the housing body is held with a small force as far as possible so as not to cause overflow of the ink from the ink supply opening, there is a possibility that the viscosity of the ink may decrease depending on the ambient temperature and the ink may overflow outside.

SUMMARY OF THE INVENTION

The present invention is achieved in order to solve the above-described problem, and provides a liquid supplying reservoir which, when a cap which covers a supply opening is removed, can prevent overflow of a liquid from the supply opening.

According to a first aspect of the present invention, a liquid supplying reservoir includes: a reservoir main body which is filled with a liquid, and at which a supply opening, from which the liquid is supplied to the outside, is formed; a cap which is fixed to the reservoir main body so as to cover the supply opening, and which is separated from the reservoir main body when a force of a predetermined value or greater acts thereon; and a flexible closing member, which is accommodated within the cap at a position or an orientation where the supply opening is not closed by the closing member and so as to be separable from the cap, and which is moved to close the supply opening when the cap is separated from the reservoir main body.

According to the liquid supplying reservoir in the first aspect, the liquid is filled in the reservoir main body, and the supply opening from which supplies the liquid to the outside is formed in the reservoir main body. The cap is fixed to the reservoir main body so as to cover the supply opening, and when force of a predetermined value or greater acts on the cap, the cap is separated from the reservoir main body.

And, in the present aspect, the flexible closing member (preferably formed so as to correspond to the shape of the supply opening) is accommodated within the cap at a position in which the supply opening is not closed so as to be separable from the cap. When the cap is removed from the reservoir main body, the closing member moves to close the supply opening.

In this manner, according to the present aspect, when the cap is removed from the reservoir main body, the flexible closing member moves to close the supply opening, and therefore, it is possible to prevent overflow the liquid from the supply opening when the cap covering the supply opening is removed.

Further, in order to achieve the above-described object, according to a second aspect of the present invention, a liquid supplying reservoir includes: a reservoir main body which is filled with a liquid, and at which a supply opening, from which the liquid is supplied to the outside, is formed; a cap which is fixed to the reservoir main body so as to cover the supply opening, and which is separated from the reservoir main body when a force of a predetermined value or greater acts thereto; and a plate-shaped member at which a through hole whose shape corresponds to a shape of the supply opening is formed, and which is fixed to an inner side of the cap so as to cover the supply opening, a position or an orientation of the through hole not corresponding to a position or an orientation of the supply opening in a state where the cap is fixed to the reservoir main body, and the position or the orientation of the through hole corresponding to the position or the orientation of the supply opening when the cap is separated from the reservoir main body; a flexible closing member having a shape corresponding to a shape of the supply opening, which is pushed into the through hole so as to be separable from the through hole, and which closes the supply opening together with the plate-shaped member in a state of being pushed into the through hole; and a moving member provided so as to move the closing member toward the reservoir main body, and which moves to separate the closing member from the plate-shaped member and to push the closing member into the supply opening when the position or the orientation of the through hole corresponds to the position or the orientation of the supply opening.

According to the liquid supplying reservoir in the second aspect, the liquid is filled in the reservoir main body, and the supply opening from which supplies the liquid to the outside is formed in the reservoir main body. The cap is fixed to the reservoir main body so as to cover the supply opening, and when force of a predetermined value or greater acts on the cap, the cap is removed from the reservoir main body.

In the present aspect, the through hole whose shape corresponds to the shape of the supply opening is formed in the plate-shaped member. In the state in which the cap is fixed to the reservoir main body, the position or orientation of the through hole does not correspond to the supply opening, and when the cap is removed from the reservoir main body, the position or orientation of the through hole corresponds to the supply opening. The plate-shaped member is fixed to the inner side of the cap so as to cover the supply opening. The flexible closing member whose shape corresponds to the shape of the supply opening is pressed in the through hole in a separable manner, and in the state in which the closing member is pressed in the through hole, the closing member closes the supply opening together with the plate-shaped member.

And, in the present aspect, the moving member is provided so as to move the closing member toward the reservoir main body, and the moving member moves the closing member such that when the position or orientation of the through hole corresponds to the supply opening, the closing member is separated from the plate-shaped member and is pressed into the supply opening.

In this manner, according to the present aspect, when the cap is removed from the reservoir main body, the position or orientation of the through hole corresponds to the supply opening and the flexible closing member moves to close the supply opening. Therefore, it is possible to prevent overflow of the liquid from the supply opening when the cap that covers the supply opening is removed.

In the liquid supplying reservoir of the second aspect, preferably, according to a third aspect of the present invention, a shape of each of the supply opening and the through hole is formed into a non-round shape (non-complete circle) in plan view; the cap is fixed to the reservoir main body such that the cap is separated from the reservoir main body when the cap is rotated by a predetermined amount on the supply opening with a central portion of the supply opening serving as a rotating axis; and the through hole is disposed such that the position and the orientation of the supply opening and the position and the orientation of the through hole coincide with each other when the cap is rotated by the predetermined amount on the supply opening with the central portion serving as the rotating axis.

As a result, the closing member can be pressed into the supply opening using a simple structure.

Furthermore, in order to achieve the above-described object, according to a fourth aspect of the present invention, a liquid supplying reservoir include: a reservoir main body which is filled with a liquid, and at which a supply opening, from which the liquid is supplied to the outside, is formed; a cap which is fixed to the reservoir main body so as to cover the supply opening, and which is separated from the reservoir main body when a force of a predetermined value or greater acts thereto; a plate-shaped member at which a through hole whose shape corresponds to a shape of the supply opening is formed, and which is fixed to an inner side of the cap such that the plate-shaped member blocks the supply opening at a portion at which the through hole is not formed in a state where the cap is fixed to the reservoir main body; a flexible closing member having a shape corresponding to a shape of the supply opening, which is pushed into the through hole so as to be separable from the through hole; and a moving member provided so as to move the closing member toward the reservoir main body, and which moves to separate the closing member from the through hole and to push the closing member into the supply opening when the position of the through hole corresponds to the position of the supply opening.

According to the liquid supplying reservoir in the fourth aspect, the liquid is filled in the reservoir main body and the supply opening from which supplies the liquid to the outside is formed in the reservoir main body. The cap is fixed to the reservoir main body so as to cover the supply opening, and when force of a predetermined value or greater acts on the cap, the cap is removed from the reservoir main body.

In the present aspect, the through hole whose shape corresponds to the shape of the supply opening is formed in the plate-shaped member, and in the state in which the cap is fixed to the reservoir main body, the plate-shaped member is fixed to the inner side of the cap so as to close the supply opening by a portion in which the through hole is not formed. The closing member is pressed in the through hole so as to be separable from the through hole.

In the present aspect, the moving member is provided so as to move the closing member toward the reservoir main body, and the moving member moves the closing member such that when the position of the through hole corresponds to the supply opening, the closing member is separated from the through hole and is pressed into the supply opening.

In this manner, according to the present aspect, when the through hole corresponds to the supply opening, the flexible closing member moves to close the supply opening. Therefore, it is possible to prevent overflow of the liquid from the supply opening when the cap that covers the supply opening is removed.

In the liquid supplying reservoir in any one of the second to fourth aspects, preferably, according to a fifth aspect of the present invention, the moving member is an urging member which is provided to urge the closing member toward the reservoir main body, and to move the closing member by an urging force thereof.

As a result, the closing member can be moved and pressed into the supply opening with using a simple structure.

Furthermore, in the liquid supplying reservoir in any one of the first through fifth aspects, preferably, according to a sixth aspect of the present invention, the cap is fixed by being bonded to the reservoir main body. As a result, the cap can be easily fixed to the reservoir main body.

Further, in the liquid supplying reservoir in the first aspect, it is preferable that the closing member has a shape corresponding to a shape of the supply opening.

Further, in the liquid supplying reservoir in any one of the first through fifth aspects, it is possible that, in plan view, the closing member has substantially the same shape and substantially the same area as those of the supply opening.

Further, in the liquid supplying reservoir in the fourth aspect, it is possible that the through hole is disposed such that the position of the supply opening and the position of the through hole coincide with each other when the cap is rotated by a predetermined amount with a central portion of the plate-shaped member serving as a rotating axis.

Further, in the liquid supplying reservoir in the first aspect, it is possible that the closing member is moved by being pushed by an inner wall of the cap member so as to close the supply opening when the cap is moved on the reservoir main body, further, it is possible that the inner wall is formed as a tapered surface, and the closing member is pushed into the supply opening by being pushed by the tapered surface.

The present invention has an effect of being capable of preventing occurrence of overflow of a liquid from a supply opening when a cap that covers the supply opening is removed.

BRIEF DESCRIPTION OF THE DRAWINGS

Embodiments of the invention will be described in detail with reference to the following figures, wherein:

FIG. 3A is a perspective view of the interior of the cap; and FIG. 3B is an exploded perspective view of the cap;

FIG. 6A is a cross sectional view showing a state in which the closing member is pressed into the ink supply opening; and FIG. 6B is a cross sectional view showing a state in which the cap is removed;

FIG. 10A is a cross sectional view showing the state before the ink supply opening is blocked; and FIG. 10B is a cross sectional view showing the state when the ink supply opening is blocked;

DETAILED DESCRIPTION OF THE INVENTION

The preferred embodiments for the present invention are described hereinafter in detail with reference to the attached drawings. In the embodiments of the present invention described below, there is described a case in which the present invention is applied to an ink tank loaded in an inkjet recording apparatus, which records an image by ejection of an ink droplet, and supplying the ink to a recording head of the inkjet recording apparatus.

Figure 1:
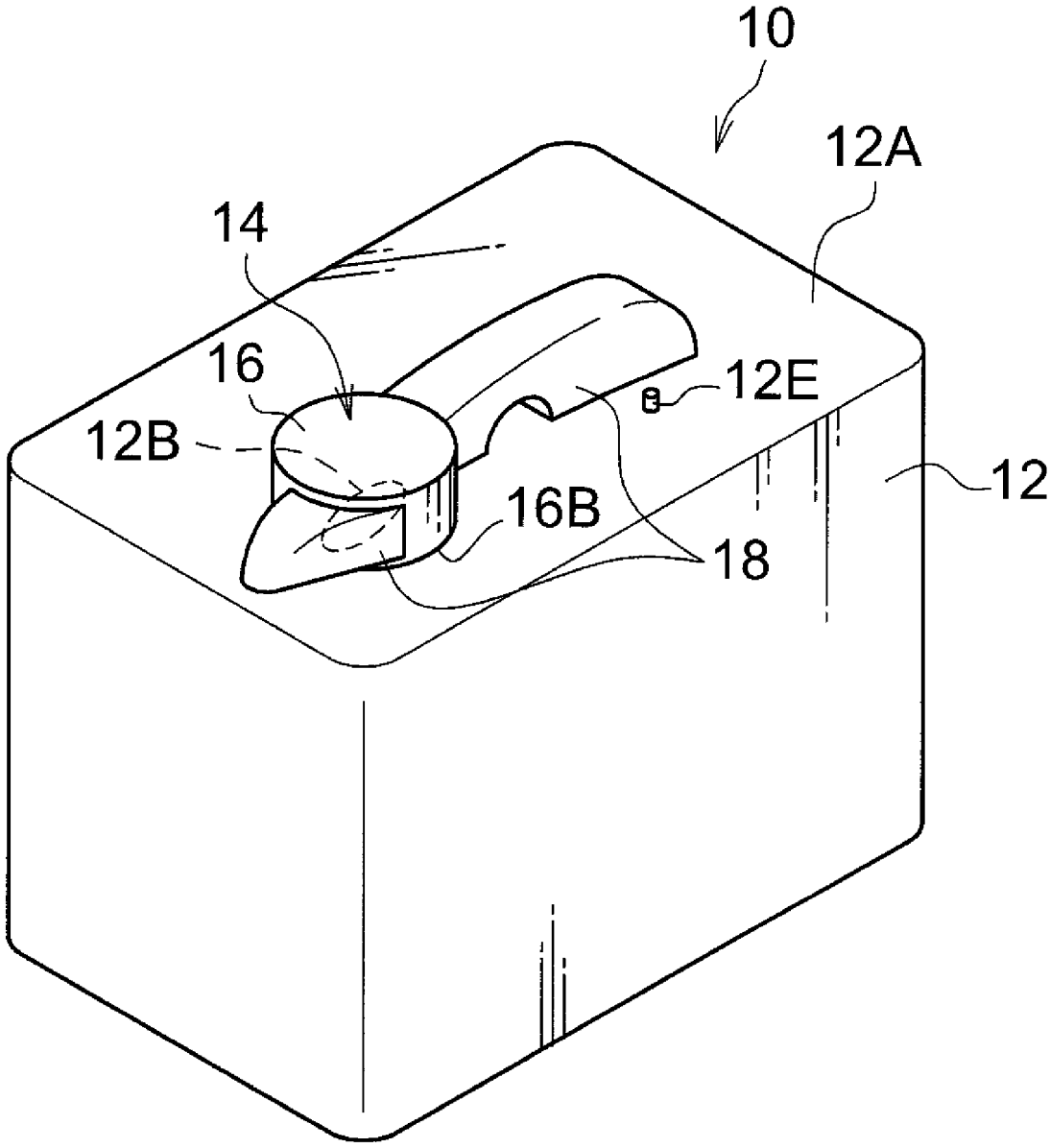
FIG. 1 is a perspective view showing the external appearance of an ink tank according to an embodiment of the present invention.

FIG. 1 shows a perspective view showing an external appearance of an ink tank according to the present embodiment. As shown in this figure, an ink tank 10 is a substantially box-shaped reservoir and includes an ink tank main body 12 in which an ink is accommodated, an ink supply opening 12B, and a cap 14. The ink supply opening 12B is provided on an upper surface 12A of the ink tank main body 10, communicates with an interior of the ink tank main body 12 and supplies therefrom the ink in the ink tank main body 12 to a recording head (not shown) of the inkjet recording apparatus. The cap 14 covers the ink supply opening 12B.

The cap 14 includes a short cylinder-shaped cap main body 16 having a bottom, which covers the ink supply opening 12B such that the axis thereof is positioned at the central portion of the ink supply opening 12B. The cap 14 further includes a pair of overhanging portions 18 which overhang from the outer peripheral surface of the cap main body 16 along the upper surface 12A toward opposite directions, respectively, with the cap main body 16 being interposed therebetween. The overhanging portions 18 applies force to the cap main body 16 by a user touching when the cap main body 16 is rotated on the ink supply opening 12B (the upper surface 12A) with the central portion of the ink supply opening 12B serving as a rotating axis.

Figure 2:
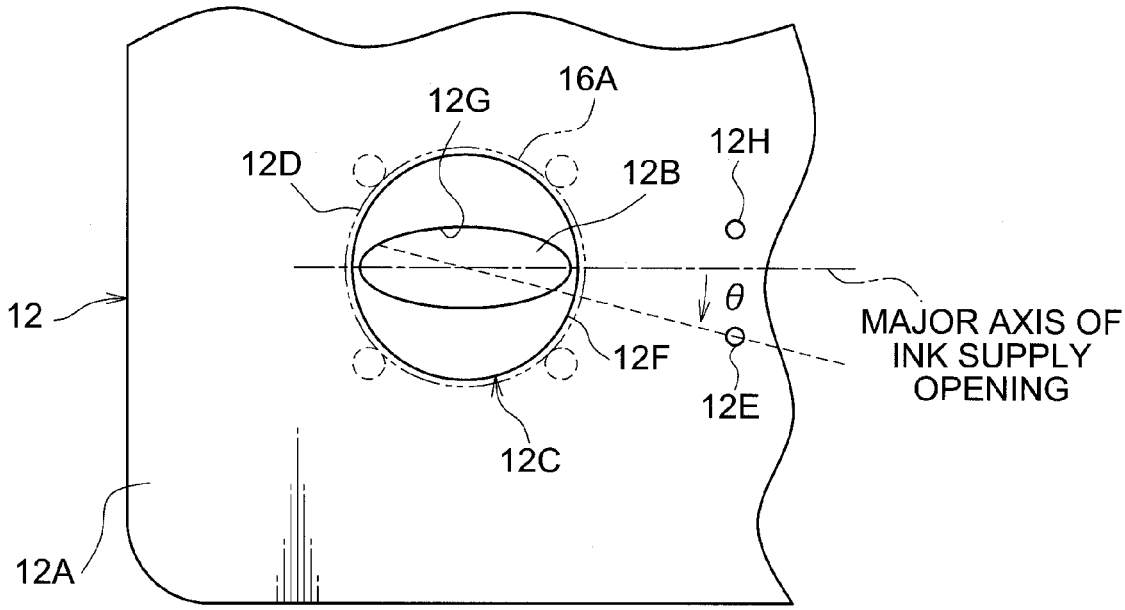
FIG. 2 is a plan view showing the structure of an ink tank main body according to an embodiment of the present invention.

FIG. 2 shows a plan view showing the structure of the ink tank main body 12 according to the present embodiment. As shown in this figure, a circular column-shaped projection 12C having the ink supply opening 12B formed at the central portion is provided on the upper surface 12A of the ink tank main body 12A, and a substantially elliptical shape ink supply opening 12B made concentric with the upper surface 12D of the projection 12C is formed in a region inside of an edge of the projection 12C. Incidentally, the projection 12C according to the present embodiment is formed such that, when an opening end 16B (refer to FIG. 1 and FIG. 6B) of the cap main body 16 is made to abut against the upper surface 12A by the projection 12B being covered with the cap main body 16, the upper surface 12D of the projection 12C comes to a position that is one-seventh or thereabouts the heightwise dimension of the cap main body 16. The heightwise dimension of the projection 12C may be appropriately determined in accordance with a size of the space inside of the cap main body 16, the thickness of the circulate plate member 22 and the size of a coil spring 24, latter two are described later, and the like.

Further, a projection 12E is provided on the upper surface 12A of the ink tank main body 12 on the same plane as the upper surface 12A at a position which is inclined clockwise when seen from the top by an angle θ (in this case, 20 degrees) with respect to a major axis of the ink supply opening 12B at the side of one of the overhanging portions 18. The projection 12E functions as a stopper that prevents further rotational movement when the cap 14 is rotated on the ink supply opening 12B, with the central portion of the ink supply opening 12B serving as the axis, in a predetermined direction (in the clockwise direction when seen from the top). Moreover, a projection 12H is provided on the upper surface 12A of the ink tank main body 12 and functions as a stopper which prevents rotation of the cap in a direction opposite to the above-described predetermined direction, in the state of coming into contact with the side surface of the overhanging portion 18 (also refer to FIG. 8).

The cap main body 16 has a structure in which the inter peripheral surface 16A thereof that forms an internal space comes into contact with an outer peripheral surface 12F of the projection 12C, and the cap main body is fixed by the opening end 16B being bonded (for example, connected them by melting the connected portion with thermal or the like) to the upper surface 12A of the ink tank main body 12. Incidentally, circles indicated by broken lines shown in FIG. 2 indicate points at which the opening end 16B of the cap main body 16 and the upper surface 12A of the ink tank main body 12 are bonded to each other. Further, in this figure, for the sake of convenience, the state in which the inner peripheral surface 16A and the outer peripheral surface 12F are made in close vicinity to each other.

Figure 3A:
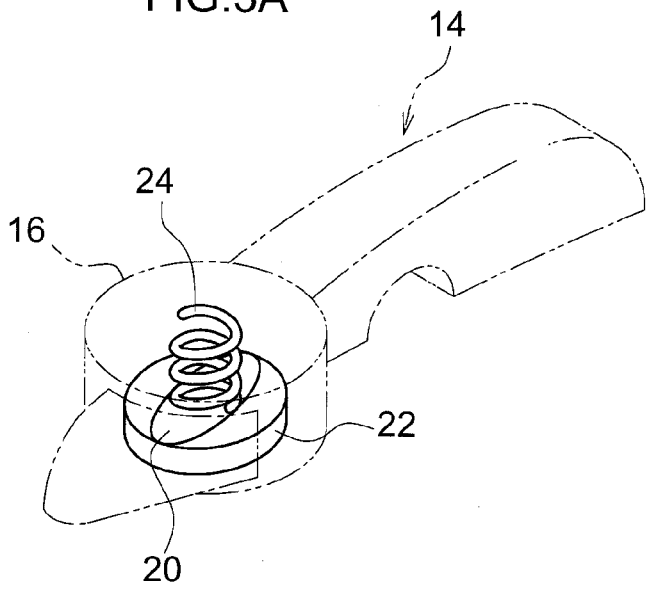
FIGS. 3A and 3B are perspective views each showing an internal structure of a cap according to an embodiment of the present invention.
Figure 3B:
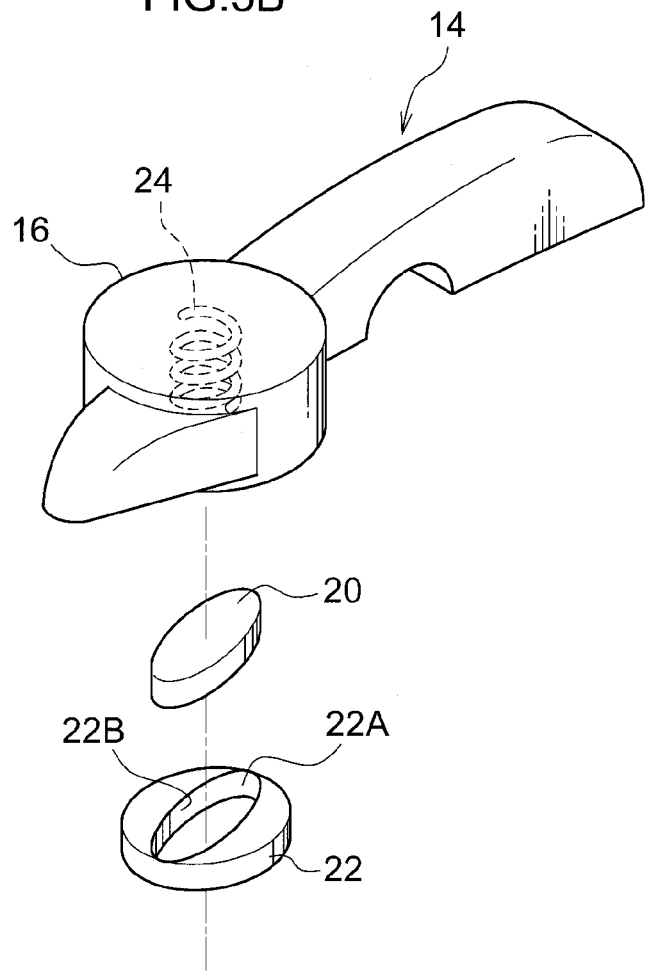

FIG. 3 shows a perspective view showing the internal structure of the cap 14 according to the present embodiment. FIG. 3A is a perspective view of an interior of the cap 14 in perspective manner and FIG. 3B is an exploded perspective view of the cap 14.

As shown in FIGS. 3A and 3B, a closing member (a closing and sealing) 20, an circular plate member 22 and a coil spring 24 are accommodated within the cap main body 16. The closing member 20 has substantially the same shape as that of the ink supply opening 12B and is made slightly larger than the ink supply opening 12 using, for example, a flexible material such as natural rubber, synthetic rubber or elastomer. When the closing member 20 is inserted in the ink supply opening 12B against its resilient restoring force, the closing member 20 closes and seals (blocks) the ink supply opening 12B by being held by a wall surface 12G (see FIG. 2) that forms the ink supply opening 12. Incidentally, it is preferable that the closing member 20 has a tapered outer peripheral surface so as to be smoothly inserted into the ink supply opening 12B.

The circular plate member 22 includes a through hole 22A substantially having the same shape of the ink supply opening 12B. The closing member 20 is pressed in (pushed in) the through hole 22A in a separable (removable) manner, and a wall surface 22B which forms the through hole 22A holds the closing member 20. Further, when the cap main body 16 is placed to cover the projection 12C and the opening end 16B of the cap main body 16 is made to abut against the upper surface 12A, the circular plate member 22 is disposed at a position at which the circular plate member 22 comes into close-contact with the upper surface 12D of the projection 12C, and is fixed to the inner peripheral surface of the cap main body 16.

Further, when the cap main body 16 is placed to cover the projection 12C and the opening end 16B of the cap main body 16 is made to abut against the upper surface 12A, the through hole 22A is formed in the circular plate member 22 such that the central portion thereof substantially coincides with that of the ink supply opening 12B. Incidentally, in the ink tank 10 according to the present embodiment, as the material which forms the circular plate member 22, synthetic resin is used, which synthetic resin is preferably more rigid than the closing member 20.

The coil spring 24 is disposed in the state of being compressed between the bottom surface of the cap main body 16 and the circular plate member 22. One end of the coil spring 24 is fixed to the bottom surface of the cap main body 16 and the other end thereof is made to abut against the closing member 20. Accordingly, the coil spring 24 urges the closing member 20 due to its resilient restoring force.

Figure 4:
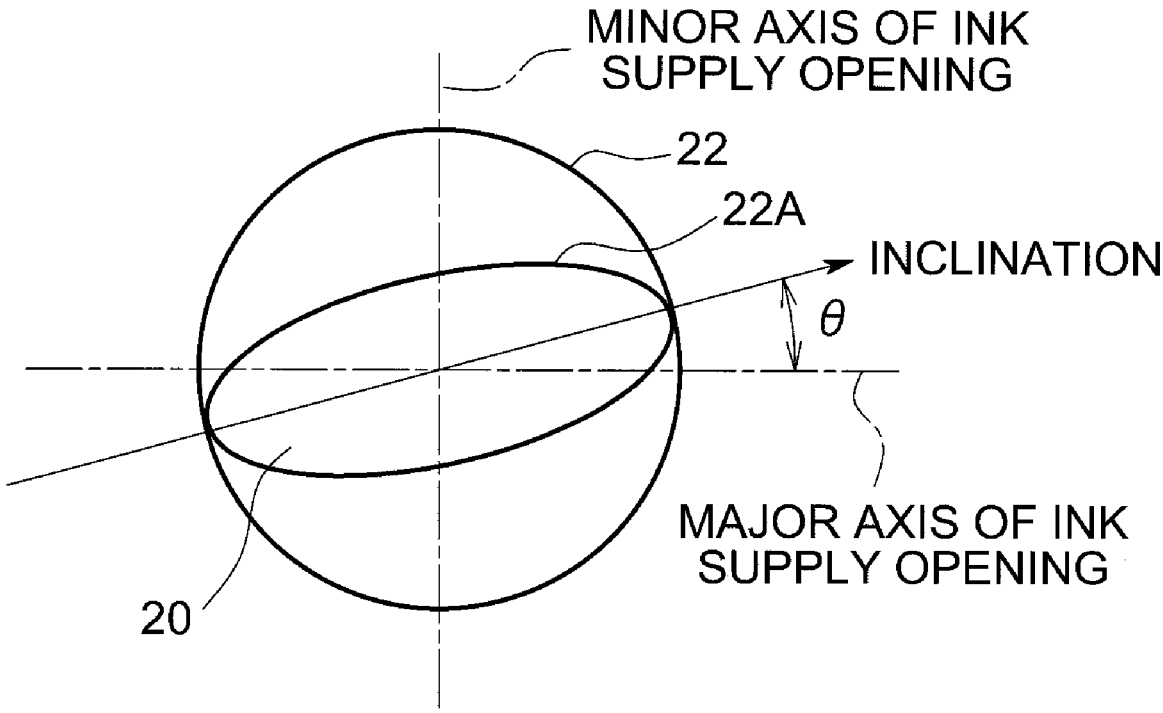
FIG. 4 is a plan view showing a position of a circular plate member in a state in which an ink tank according to an embodiment of the present invention is not opened.

The cap 14 as structured above is fixed to the ink tank main body 12 in such a manner that, in the state in which the orientation (and position) of the ink supply opening 12B and the orientation (and position) of the through hole 22A does not coincide with each other when the cap main body 16 encloses the projection 12C and the opening end 16B is made to abut against the upper surface 12A, it is bond to the upper surface 12A of the ink tank main body 12, thereby fixed to the ink tank main body 12. In the ink tank 10 according to the present embodiment, as shown in FIG. 4 by way of example, the cap main body 16 is bonded and fixed to the upper surface 12A of the ink tank main body 12 in the state in which the major axis of the through hole 22A is inclined with respect to the major axis of the ink supply opening 12B by an angle θ.

Next, the operation of the ink tank 10 according to the present embodiment is described.

As shown in FIG. 1, when the ink supplying opening 12B of the ink tank 10 in the state in which the cap 14 is fixed to the ink tank main body 12 (a sealed state) is unsealed (opened), first, a user applies force to the cap main body 16 via the overhanging portions 18 so that the cap main body 16 rotates on the ink supply opening 12B with the central portion of the ink supply opening 12B serving as the axis. When force of a predetermined value or greater acts on the cap main body 16, the portion at which the cap main body 16 and the ink tank main body 12 are bonded is sheared off, and the cap main body 16 rotates in the direction to which the force acts.

Figure 5:
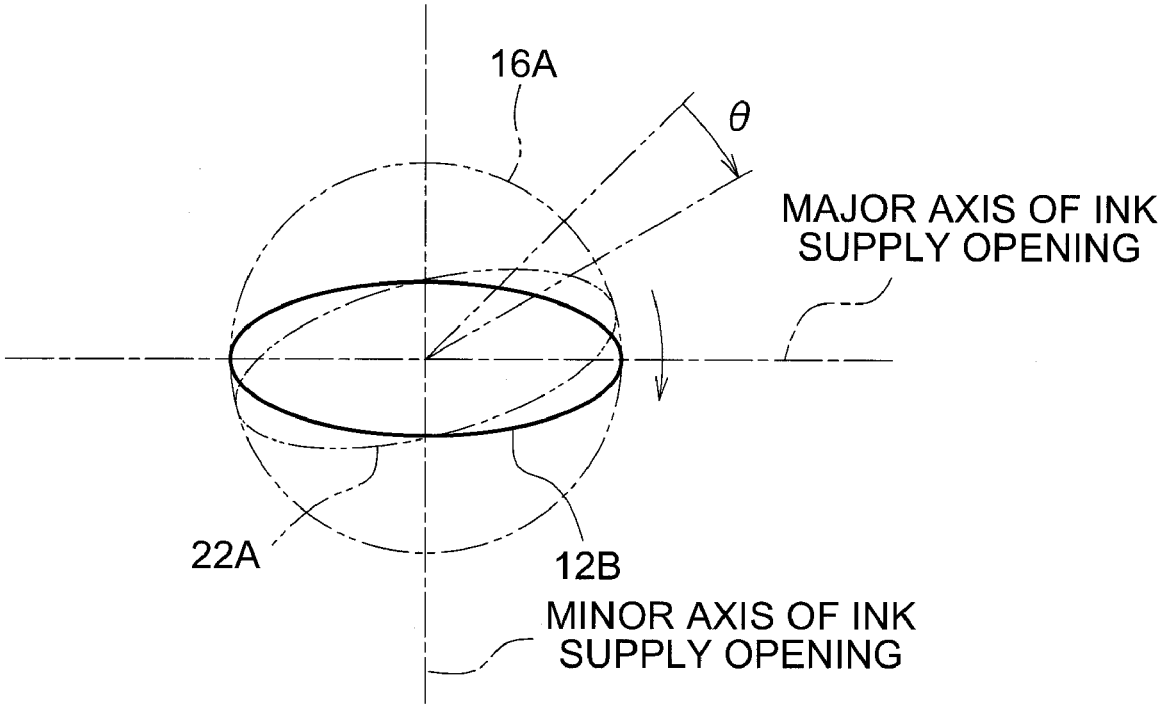
FIG. 5 is an explanatory diagram used for illustrating a positional relationship between a closing member and an ink supply opening of the ink tank according to an embodiment of the present invention.
Figure 6A:
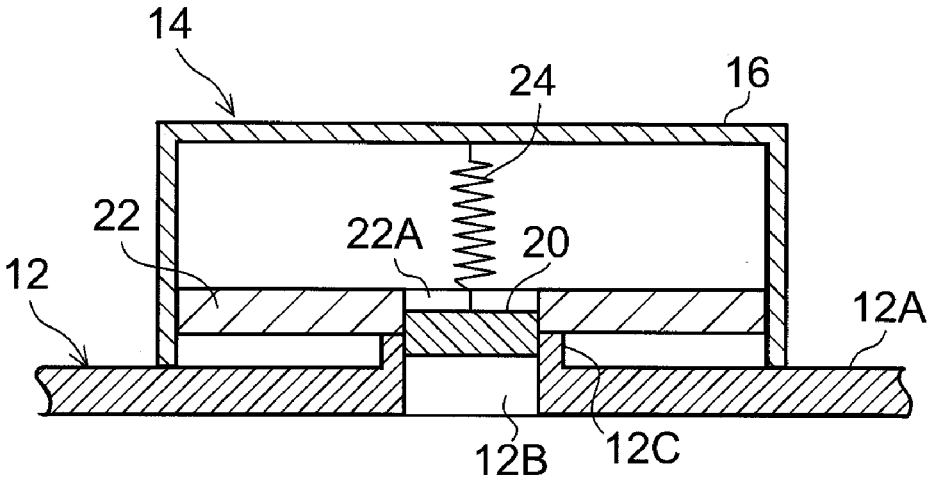
FIGS. 6A and 6B are cross sectional views each showing a state in which an ink supply opening of an ink tank body according to an embodiment of the present invention is blocked.
Figure 6B:
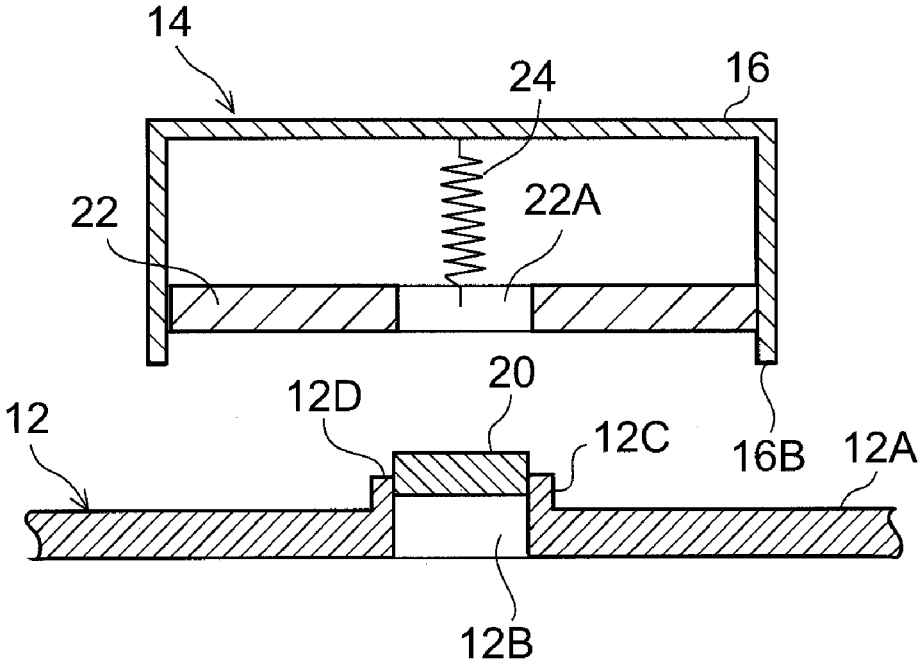
Figure 7:
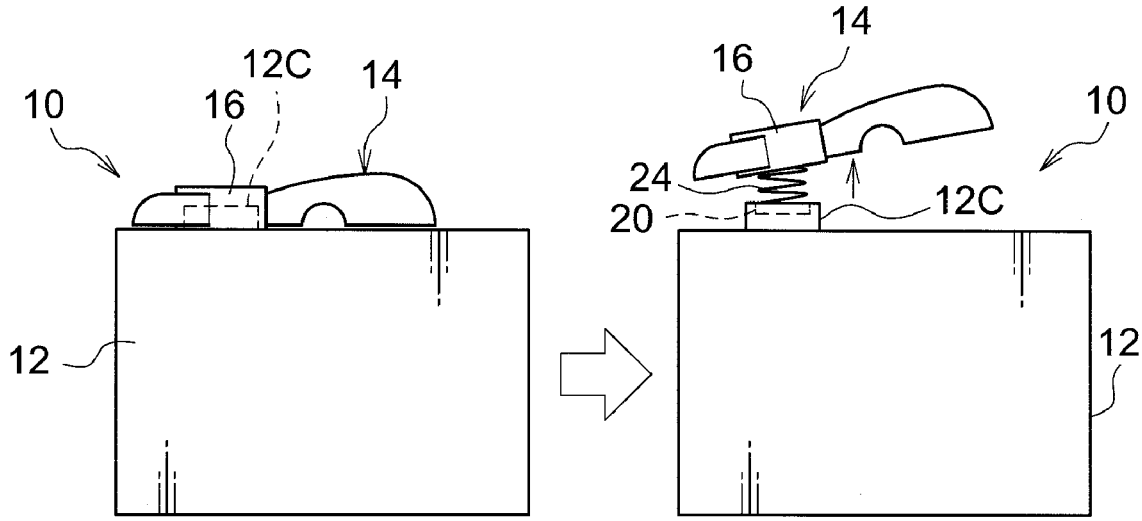
FIG. 7 is a transition diagram showing the states before and after the cap is removed from the ink tank main body according to an embodiment of the present invention.
Figure 8:
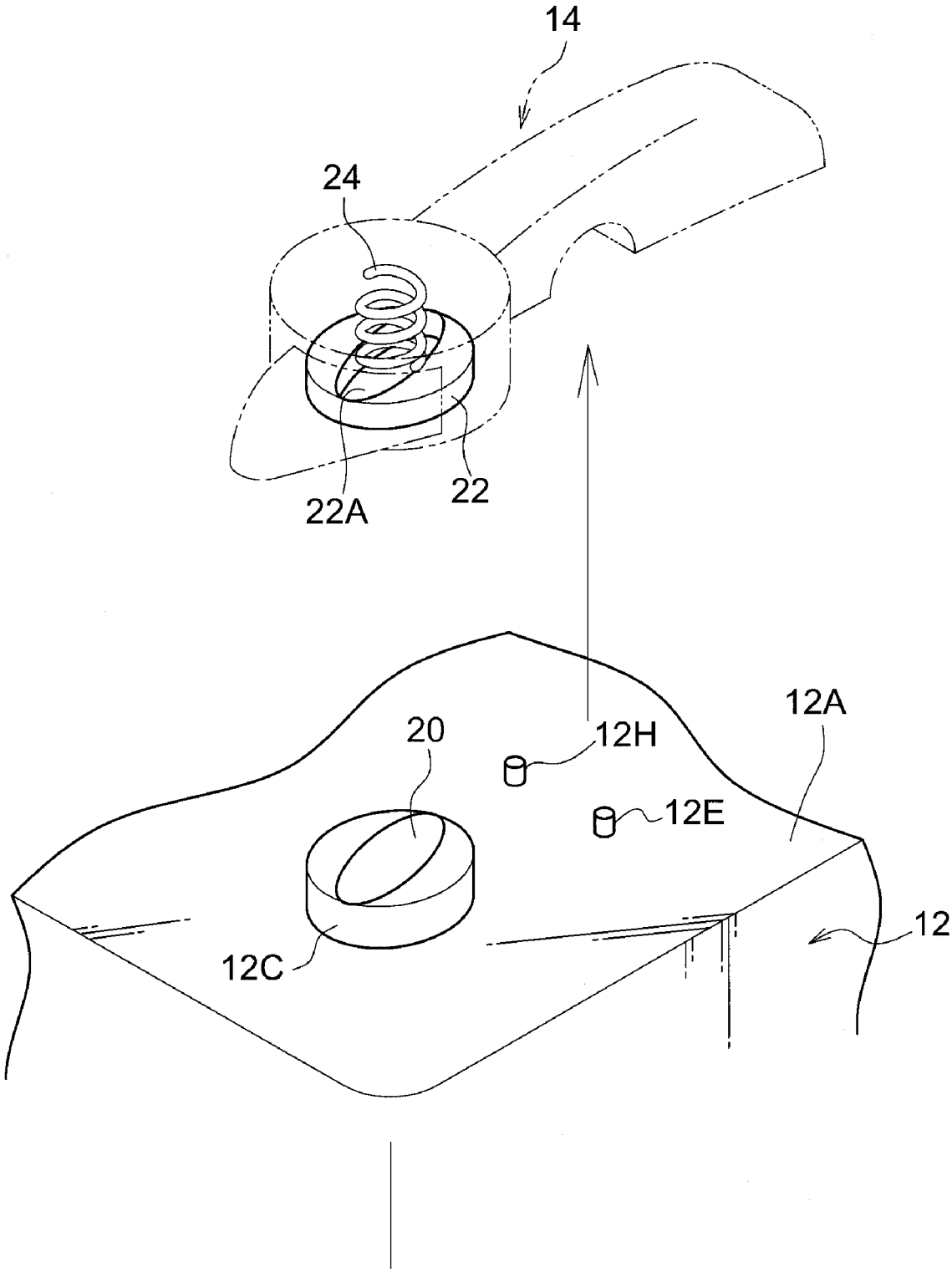
FIG. 8 is a perspective view showing the state in which the cap is removed from the ink tank main body according to an embodiment of the present invention.

By way of example, as shown in FIG. 5, when the cap main body 16 rotates on the ink supply opening 12B by an angle θ with the central portion of the ink supply opening 12B serving as the axis, the one of the overhanging portions 18 abuts against the projection 12E so as to stop rotation of the cap 14, and at the same time, the orientation (and position) of the through hole 22A substantially coincides with the orientation (and position) of the ink supply opening 12B. At this time, by way of example, as shown in FIG. 6A, the closing member 20 urged by the coil spring 24 is pressed (pushed) into the ink supply opening 12B and the ink supplying opening 12B is closed. With the above-described state being maintained, by way of example, as shown in FIGS. 6B, 7 and 8, when the cap 14 is lifted upward, only the closing member 20 is separated (removed) from the cap 14, and the state in which the ink supply opening 12B is closed by the closing member 20 is maintained even after the cap 14 is removed from the ink tank main body 12. As a result, overflow of an ink from the ink supply opening 12B when the cap 14 covering the ink supply opening 12B is removed is prevented.

As described above in detail, the ink tank 10 according to the present embodiment includes a reservoir main body (here, the ink tank main body 12) which is filled with a liquid (here, the ink), (which can contains a liquid) and at which a supply opening (here, the ink supply opening 12B), from which the liquid is supplied to the outside (here, to a recording head of the inkjet recording apparatus), is formed; the cap which is fixed to the reservoir main body so as to cover the supply opening, and which is separated from the reservoir main body when a force of a predetermined value or greater acts thereon; and the flexible closing member 20, which is accommodated within the cap 14 at a position or an orientation where the supply opening is not closed by the closing member 20 and so as to be separable from the cap 14, and which is moved to close the supply opening when the cap 14 is separated from the reservoir main body.

Therefore, overflow of the liquid from the supply opening when the cap 14 covering the supply opening 14 is removed can be prevented.

Further, the ink tank 10 according to the present embodiment includes a reservoir main body which is filled with a liquid (which can contains a liquid), and at which a supply opening, from which the liquid is supplied to the outside, is formed; the cap 14 which is fixed to the reservoir main body so as to cover the supply opening, and which is separated from the reservoir main body when a force of a predetermined value or greater acts thereto; and a plate-shaped member (here, a circular plate member 22) at which the through hole 22A whose shape corresponds to a shape of the supply opening is formed, and which is fixed to an inner side of the cap 14 so as to cover the supply opening, a position or an orientation of the through hole 22A not corresponding to a position or an orientation of the supply opening in a state where the cap 14 is fixed to the reservoir main body, and the position or the orientation of the through hole 22A corresponding to the position or the orientation of the supply opening when the cap 14 is separated from the reservoir main body; the flexible closing member 20 having a shape corresponding to a shape of the supply opening, which is pushed into the through hole 22A so as to be separable from the through hole 22A, and which closes the supply opening together with the plate-shaped member 22 in a state of being pushed into the through hole 22A; and a moving member (here, the coil spring 24) provided so as to move the closing member 20 toward the reservoir main body, and which moves to separate the closing member 20 from the plate-shaped member 22 and to push the closing member 20 into the supply opening when the position or the orientation of the through hole corresponds to the position or the orientation of the supply opening. Therefore, it is possible to prevent overflow of the liquid from the supply opening when the cap 14 covering the supply opening is removed.

Moreover, according to the ink tank 10 of the present embodiment, the shapes (when seen along the rotating axis) of the supply opening and the through hole 22A are each made into a non-round shape (non-complete circle) (here, a substantially elliptical shape). When the cap 14 is rotated on the supply opening with the central portion of the supply opening serving as the axis, the cap 14 is fixed to the reservoir main body so as to be separable from the reservoir main body, and the through hole 22 is disposed such that when the cap 14 is rotated on the supply opening by a predetermined amount with the central portion of the supply opening serving as the axis, the orientation (and position) of the supply opening and the orientation (and position) of the through hole 22A coincide with each other. Thus, the closing member 20 can be pressed into the supply opening with using a simple structure.

Furthermore, according to the ink tank 10 of the present embodiment, the moving member is structured by the urging member (here, the coil spring 24) which is provided so as to urge the closing member 20 toward the reservoir main body, and moves the closing member 20 by means of the urging force thereof. As a result, the closing member 20 can be moved and pressed into the supply opening with using a simple structure.

Still further, according to the ink tank 10 of the present embodiment, the cap 14 is fixed to the reservoir main body by bonding, and therefore, the cap 14 can be easily fixed to the reservoir main body.

The present invention is described as above by means of the aforementioned embodiment, but the technical scope of the present invention is not limited to the scope mentioned in the aforementioned embodiment. Various modifications or improvements can be added to the aforementioned embodiment without departing the scope of the invention, and the modes with the modifications or improvements added thereto are also involved in the technical scope of the present invention.

Further, the invention recited in the scope of aspects is not limited by the aforementioned embodiment, and all of combinations of features described in the aforementioned embodiment is not necessarily essential to the means for solving the invention. The aforementioned embodiment includes various stages of invention, and various inventions can be extracted by context-sensitive combinations in the disclosed plural constitutive requirements. Even if some of the constitutive requirements is eliminated from all of the constitutive requirements shown in the aforementioned embodiment, as long as the effects of the invention are obtained, a structure from which some of the constitutive requirements is eliminated can be extracted as the invention.

For example, in the aforementioned embodiment, the circular plate member 22 which is structured in such a manner that, by rotating the cap main body 16 on the supply opening 12B in a predetermined direction by an angle θ with the central portion of the ink supply opening 12B serving as the axis, the orientation of the through hole 22A is made to substantially coincide with the orientation of the ink supply opening 12B, is described by way of example. However, the present invention is not limited to the same, and for example, a circular plate member 30 shown in FIG. 9 may be also applied. As shown in this figure, the circular plate member 30 includes a through hole 30B similar to the through hole 22A around the center 30A. The closing member 20 is pressed (pushed) in the through hole 30B. The cap main body 16 is fixed on the upper surface 12A of the ink tank main body 12 such that the position (and orientation) of the through hole 30B does not coincide with the position (and orientation) of the ink supply opening 12B. Further, the coil spring 24 is accommodated within the cap main body 16 and urges the closing member 20 toward the upper surface 12A of the ink tank main body 12. Then, the cap main body 16 is rotated with the center 30A serving as the rotating axis, and when the position (and orientation) of the through hole 30B and the position (and orientation) of the ink supply opening 12B substantially coincide to each other, the closing member 20 held by a wall surface that forms the through hole 30B is pressed into the ink supply opening 12B by means of the urging force of the coil spring 24.

As described above, by providing: the reservoir main body 12 which is filled with the ink (which can contains the ink), and at which the supply opening 12B, from which the ink is supplied to the outside, is formed; the cap 14 which is fixed to the reservoir main body 12 so as to cover the supply opening 12B, and which is separated from the reservoir main body 12 when a force of a predetermined value or greater acts thereto; the plate-shaped member 30 at which the through hole 30B whose shape corresponds to a shape of the supply opening 12B is formed, and which is fixed to an inner side of the cap 14 such that the plate-shaped member 30 blocks (closes) the supply opening 12B at a portion at which the through hole 30B is not formed in a state where the cap 14 is fixed to the reservoir main body 12; the flexible closing member 20 having a shape corresponding to a shape of the supply opening 12B, which is pushed into the through hole 30B so as to be separable from the through hole 30B; and the coil spring 24 provided so as to move the closing member 20 toward the reservoir main body 12, and which moves to separate the closing member 20 from the through hole 30B and to push the closing member 20 into the supply opening 12B when the position of the through hole 30B corresponds to the position of the supply opening 12B, it is possible to prevent overflow of the ink from the ink supply opening 12B when the cap 14 covering the ink supply opening 12B is removed.

Figure 10A:
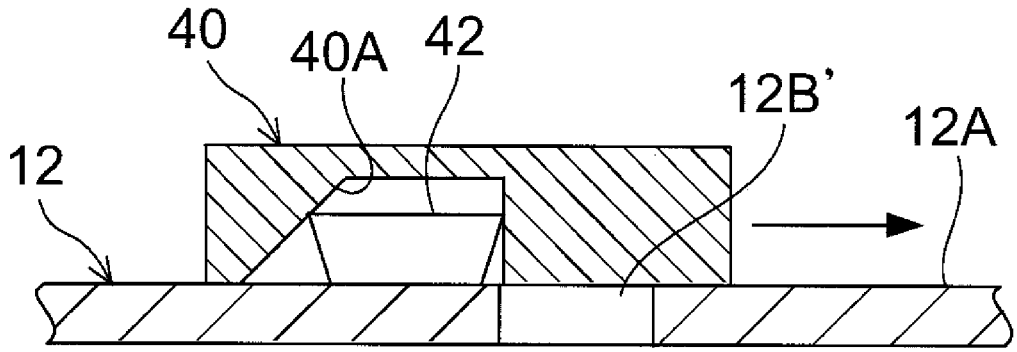
FIGS. 10A and 10B are cross sectional views showing a modified example of an ink tank according to an embodiment of the present invention.
Figure 10B:
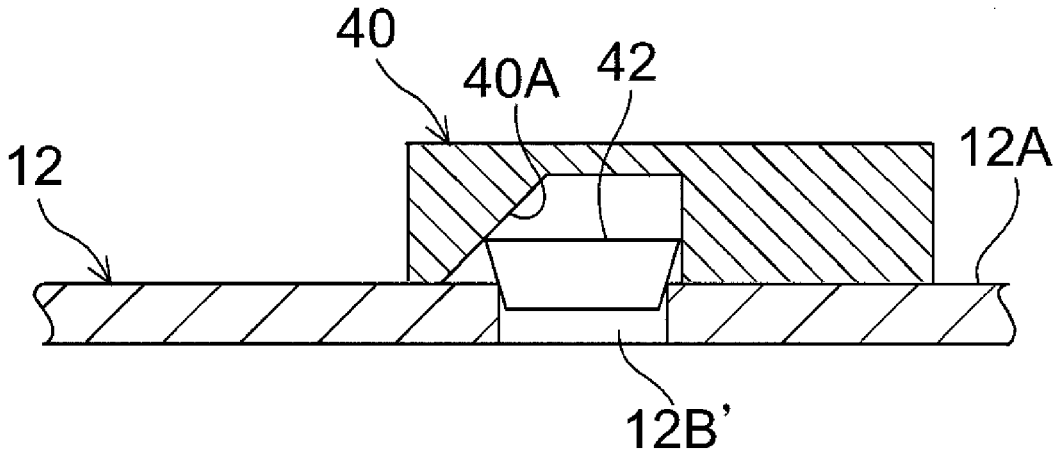
Figure 11:
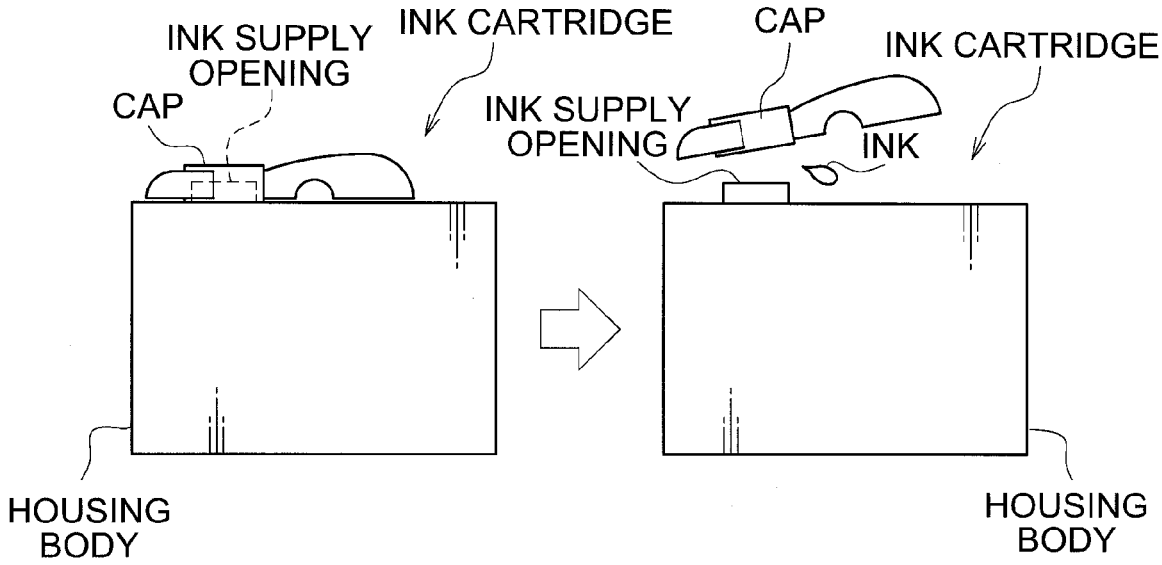
FIG. 11 is a diagram used for illustration of a conventional art.

Further, in the aforementioned embodiment, the example in the case in which the ink supply opening 12B is closed by rotating the cap and pressing the closing member 20 into the ink supply opening 12B is described, but the present invention is not limited to the same. By way of example, as shown in FIGS. 10A and 10B, the ink supply opening 12B may also be closed by causing a cap 40 to move slidingly on the upper surface 12A of the ink tank main body 12. In this case, a substantially straight-line groove (not shown) is formed on the upper surface 12A so that the cap 40 can be made to move sliding on the upper surface 12A of the ink tank main body 12 in a direction indicated by arrow in FIG. 10A, and an open end of the cap 40 is engaged with the groove. At this time, an ink supply opening 12B' formed on the upper surface 12A of the ink tank main body 12 is covered by a part of the open end of the cap 40 (FIG. 10A). In this state, the open end of the cap 40 is bonded to the upper surface 12A in the same manner as in the aforementioned embodiment. A flexible closing member 42 which can be pressed (pushed) into the ink supply opening 12B' is accommodated within the cap 40 so as to be able to move slidingly only in the direction indicated by arrow in FIG. 10A. A part of the closing member 42 is bonded to the upper surface 12A of the ink tank main body 12, and when force of a predetermined value or greater acts on, the bonded portion is sheared off. A portion of an inner wall of the cap 40 is formed as a tapered surface 40A, and the tapered surface 40A abuts against the upper edge of the closing member 42. When force acts on the cap 40 such that the cap 40 is made to move sliding in the direction indicated by arrow in FIG. 10A, the closing member 42 is pressed by the tapered surface 40A of the cap 40. When force of a predetermined value or greater acts on the closing member 42 via the cap 40, the bonded portion of the closing member 42 and the upper surface 12A of the ink tank main body 12 is sheared off, and the closing member 42 moves sliding in the same direction together with the cap 40, and thereafter, as shown in FIG. 10B, for example, the closing member 42 is engaged with the ink supply opening 12B'. Then, when force further acts on the cap 40 in the direction indicated by arrow in the same figure, the closing member 42 is pressed by the tapered surface 40A and is pressed (pushed) into the ink supply opening 12B'. Subsequently, even if the cap 40 is separated from the upper surface 12A, the state in which the ink supply opening 12B' is closed by the closing member 42 is maintained.

Moreover, in the aforementioned embodiment, an example in a case in which the closing member 20 is urged by the coil spring 24 is described, but the present invention is not limited to the same. Other springs such as a plate spring, a torsion spring and the like may also be used. As long as the urging member allows the closing member 20 to be separated from the circular plate member 22 and can apply, to the closing member 20, urging force which is sufficient to cause the closing member 20 to be pressed into the ink supply opening 12B, any type of urging member may also be used.

Figure 12:
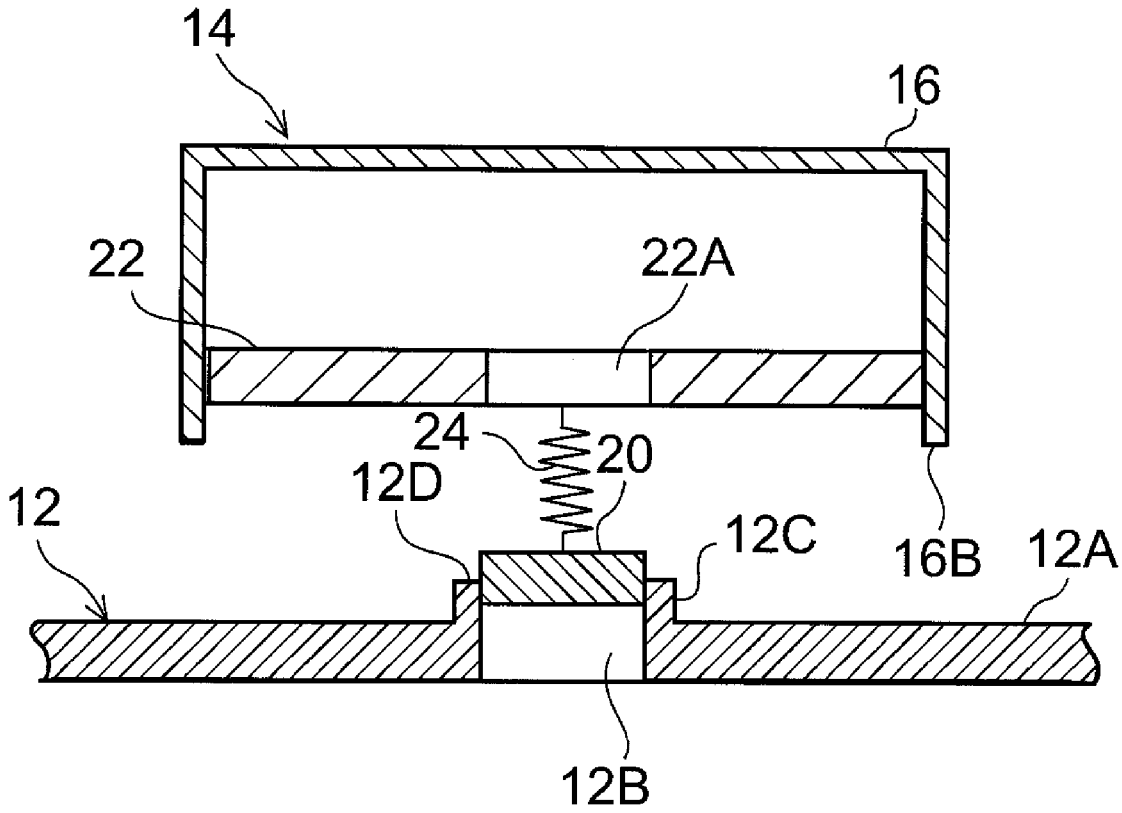
FIG. 12 is a cross sectional view showing an example of a state in which a closing member is pressed into an ink supply opening of an ink tank main body according to an embodiment of the present invention.

In the aforementioned embodiment, an example in a case in which when the cap 14 is removed from the ink tank main body 12, only the closing member 20 is removed from the cap 14 is described, but the present invention is not limited to the same. By way of example, as shown in FIG. 12, a structure in which when the cap 14 is removed from the ink tank main body 12, not only the closing member 20, but also the coil spring 24 are brought into the state of being removed from the cap 14 may also be possible.

In the aforementioned embodiment, an example in a case in which the circular plate member 22 with the closing member 20 being mounted thereto is fixed on the inner peripheral surface of the cap main body 16, but the present invention is not limited to the same. For example, a frame in which the closing member 20 is pressed (pushed) may be fixed on the inner peripheral surface of the cap main body 16 via a rib.

In the aforementioned embodiment, an example in a case in which the closing member 20 is pressed in the through hole 22A of the circular plate member 20 is described, but the present invention is not limited to the same. The circular plate member 20 may not be required.

Figure 9:
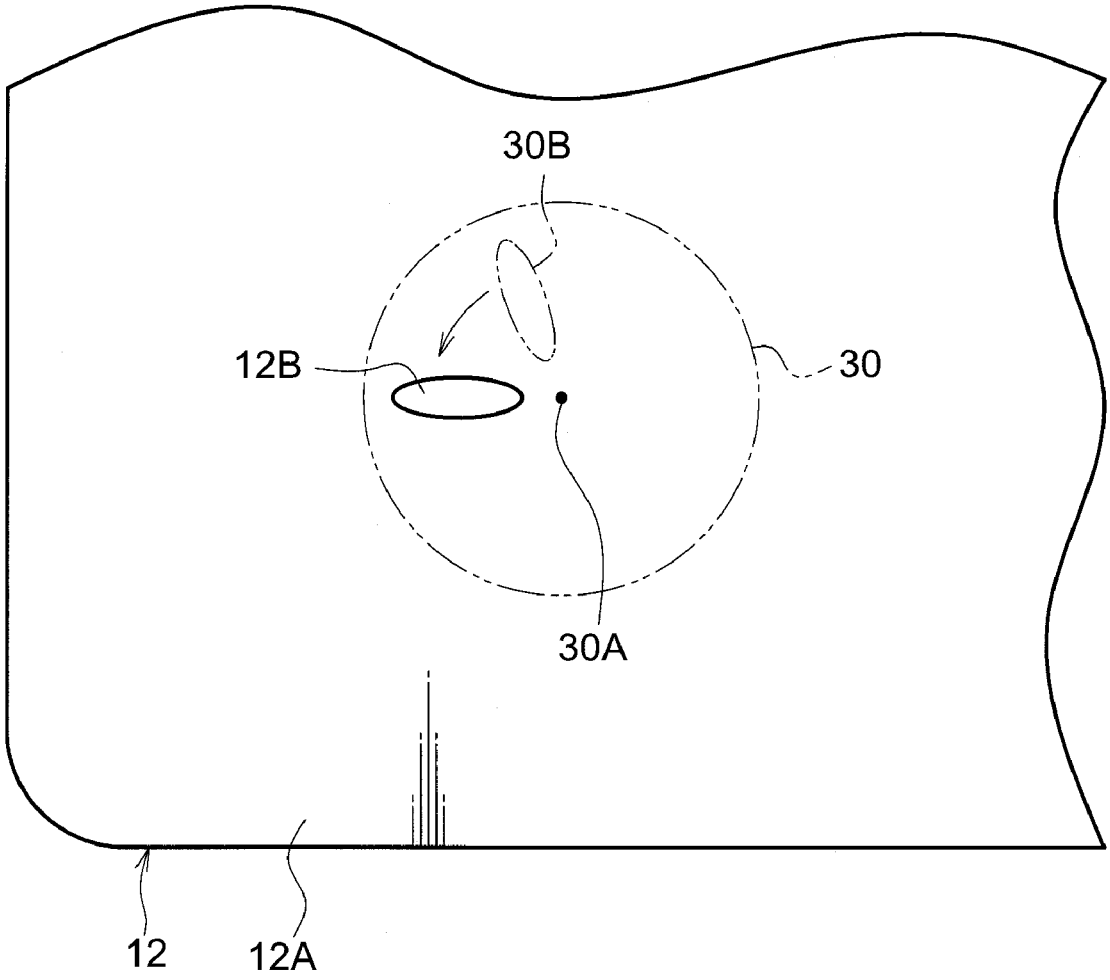
FIG. 9 is a plan view showing a modified example of an ink tank according to an embodiment of the present invention.

In the aforementioned embodiment, the shapes of the ink supply opening 12B and the through hole 22A are each formed so as to have a substantially elliptical configuration, but the present invention is not limited to the same. For example, these shapes may be a triangle or a rectangle. Any type of non-round shape may be used in the embodiment shown in FIGS. 1-8. However, in the case as shown in FIG. 9, the shapes of the ink supply opening 12B and the through hole 30B may be each formed to have a round shape.

In the aforementioned embodiment, an example in a case in which a cap 14 in the form of being bonded to the ink tank main body 12 is used is described, but the present invention is not limited to the same. Any jointing (connecting) method can be applied in bonding. Further, for example, a screw cap may also be used, and the type of cap may be appropriately determined.

In the aforementioned embodiment, the circular plate member 22 is described by way of example, but the present invention is not limited to the same. Any shape of plate-like member can be applied.

The structure of the ink tank 10 described in the aforementioned embodiment (refer to FIGS. 1 to 8) is shown as an example, and the modification can be made according to the situation without departing from the spirit of the invention.

What is claimed is:

1. A liquid supplying reservoir comprising:

a reservoir main body which is filled with a liquid, and at which a supply opening, from which the liquid is supplied to the outside, is formed;

a cap which is fixed to the reservoir main body so as to cover the supply opening, and which is separated from the reservoir main body when a force of a predetermined value or greater acts thereon; and a flexible closing member, which is accommodated within the cap at a position or an orientation where the supply opening is not closed by the closing member and so as to be separable from the cap, and which is moved to close the supply opening when the cap is separated from the reservoir main body.

2. The liquid supplying reservoir of claim 1, wherein the cap is fixed by being bonded to the reservoir main body.

3. The liquid supplying reservoir of claim 1, wherein the closing member has a shape corresponding to a shape of the supply opening.

4. The liquid supplying reservoir of claim 1, wherein, in plan view, the closing member has substantially the same shape and substantially the same area as those of the supply opening.

5. The liquid supplying reservoir of claim 1, wherein the closing member is moved by being pushed by an inner wall of the cap member so as to close the supply opening when the cap is moved on the reservoir main body.

6. The liquid supplying reservoir of claim 5, wherein the inner wall is formed as a tapered surface, and the closing member is pushed into the supply opening by being pushed by the tapered surface.

7. The liquid supplying reservoir of claim 1, wherein the closing member is accommodated within the cap at the position or the orientation where the supply opening is not closed by the closing member in a state where the cap is fixed to the reservoir main body.

8. The liquid supplying reservoir of claim 7, wherein the flexible closing member is moved to close the supply opening 12B when the cap is moved on the reservoir main body and the cap is separated from the reservoir main body.

9. A liquid supplying reservoir comprising:

a reservoir main body which is filled with a liquid, and at which a supply opening, from which the liquid is supplied to the outside, is formed;

a cap which is fixed to the reservoir main body so as to cover the supply opening, and which is separated from the reservoir main body when a force of a predetermined value or greater acts thereto; and a plate-shaped member at which a through hole whose shape corresponds to a shape of the supply opening is formed, and which is fixed to an inner side of the cap so as to cover the supply opening, a position or an orientation of the through hole not corresponding to a position or an orientation of the supply opening in a state where the cap is fixed to the reservoir main body, and the position or the orientation of the through hole corresponding to the position or the orientation of the supply opening when the cap is separated from the reservoir main body;

a flexible closing member having a shape corresponding to the shape of the supply opening, which is pushed into the through hole so as to be separable from the through hole, and which closes the supply opening together with the plate-shaped member in a state of being pushed into the through hole; and a moving member provided so as to move the closing member toward the reservoir main body, and which moves to separate the closing member from the plate-shaped member and to push the closing member into the supply opening when the position or the orientation of the through hole corresponds to the position or the orientation of the supply opening.

10. The liquid supplying reservoir of claim 9, wherein:

a shape of each of the supply opening and the through hole is formed into a non-round shape in plan view;

the cap is fixed to the reservoir main body such that the cap is separated from the reservoir main body when the cap is rotated by a predetermined amount on the supply opening with a central portion of the supply opening serving as a rotating axis; and the through hole is disposed such that the position and the orientation of the supply opening and the position and the orientation of the through hole coincide with each other when the cap is rotated by the predetermined amount on the supply opening with the central portion serving as the rotating axis.

11. The liquid supplying reservoir of claim 9, wherein the moving member is an urging member which is provided to urge the closing member toward the reservoir main body, and to move the closing member by an urging force thereof.

12. The liquid supplying reservoir of claim 9, wherein the cap is fixed by being bonded to the reservoir main body.

13. A liquid supplying reservoir comprising:

a reservoir main body which is filled with a liquid, and at which a supply opening, from which the liquid is supplied to the outside, is formed;

a cap which is fixed to the reservoir main body so as to cover the supply opening, and which is separated from the reservoir main body when a force of a predetermined value or greater acts thereto;

a plate-shaped member at which a through hole whose shape corresponds to a shape of the supply opening is formed, and which is fixed to an inner side of the cap such that the plate-shaped member blocks the supply opening at a portion at which the through hole is not formed in a state where the cap is fixed to the reservoir main body;

a flexible closing member having a shape corresponding to the shape of the supply opening, which is pushed into the through hole so as to be separable from the through hole; and a moving member provided so as to move the closing member toward the reservoir main body, and which moves to separate the closing member from the through hole and to push the closing member into the supply opening when the position of the through hole corresponds to the position of the supply opening.

14. The liquid supplying reservoir of claim 13, wherein the moving member is an urging member which is provided to urge the closing member toward the reservoir main body, and to move the closing member by urging force thereof.

15. The liquid supplying reservoir of claim 13, wherein the cap is fixed by being bonded to the reservoir main body.

16. The liquid supplying reservoir of claim 13, wherein the through hole is disposed such that the position of the supply opening and the position of the through hole coincide with each other when the cap is rotated by a predetermined amount with a central portion of the plate-shaped member serving as a rotating axis.

* * * * *